US005109986A

United States Patent [19]

Pruitt, Jr.

[11] Patent Number: 5,109,986

[45] Date of Patent: May 5, 1992

[54] PALLET BOX CONTAINER

[76] Inventor: John F. Pruitt, Jr., 2140 Audobon, S.W., Wyoming, Mich. 49509

[21] Appl. No.: 696,198

[22] Filed: May 6, 1991

[51] Int. Cl.[5] ..... B65D 19/16

[52] U.S. Cl. ..... 206/600

[58] Field of Search ..... 206/600

[56] References Cited

FOREIGN PATENT DOCUMENTS 2624831 6/1989 France ..... 206/600

674732 7/1990 Switzerland ..... 206/600

*Primary Examiner*—William I. Price

*Attorney, Agent, or Firm*—Price, Heneveld, Cooper, DeWitt & Litton

[57] ABSTRACT

The specification discloses a collapsible pallet box or container composed of a pallet platform and four upright panels connected together at the corner edges by flexible belting at the top and bottom to form a polygon expandable or collapsible to a rectangle or a flattened parallelogram. The bottom of the polygon panels are removably attached to the pallet, preferably by a tongue and groove arrangement of tongues extending from the pallet and grooves in the panels. The tops of the panels have stabilizing, wedging compression elements therebetween at the panel corners to stabilize the panel tops in the expanded rectangular configuration and to keep the panels locked to the pallet.

16 Claims, 4 Drawing Sheets

PALLET BOX CONTAINER

BACKGROUND OF THE INVENTION

This invention relates to pallet box containers.

Pallets to support articles for storage and transport are widely used in industry and commerce. Pallet boxes are typically used to retain loose articles for storage and/or transport. Such pallet boxes are normally made of wood, having the sides of the box secured to the pallet and each other by nails or other fasteners. After receipt of the shipped articles, a good share of the pallet boxes are smashed and burned or otherwise disposed of since the cost of returning the empty containers is too much to make it worthwhile. Of course, this constitutes a waste of resources, as well as potentially adding pollutants and carbon dioxide to the atmosphere, if burned.

SUMMARY OF THE INVENTION

An object of this invention is to provide a collapsible pallet box container that is readily set up from the components of a pallet and a collapsed polygon of panels. The assembly can be largely formed of wood, requires only seconds to set up, is sturdy when used to store and ship articles and, when emptied, can be collapsed flat in seconds to be capable of economical return at reasonable cost to the supplier or elsewhere.

The vertical panels are secured together by tensile belting comparable to that used for vehicle seat belts, to have a readily attachable/detachable connection to a pallet, preferably by a snap-in tongue and groove arrangement, and are stabilized at the upper ends of the panels by wedging compression elements inserted between opposite panels.

DESCRIPTION OF THE PREFERRED EMBODIMENT

Figure 1:
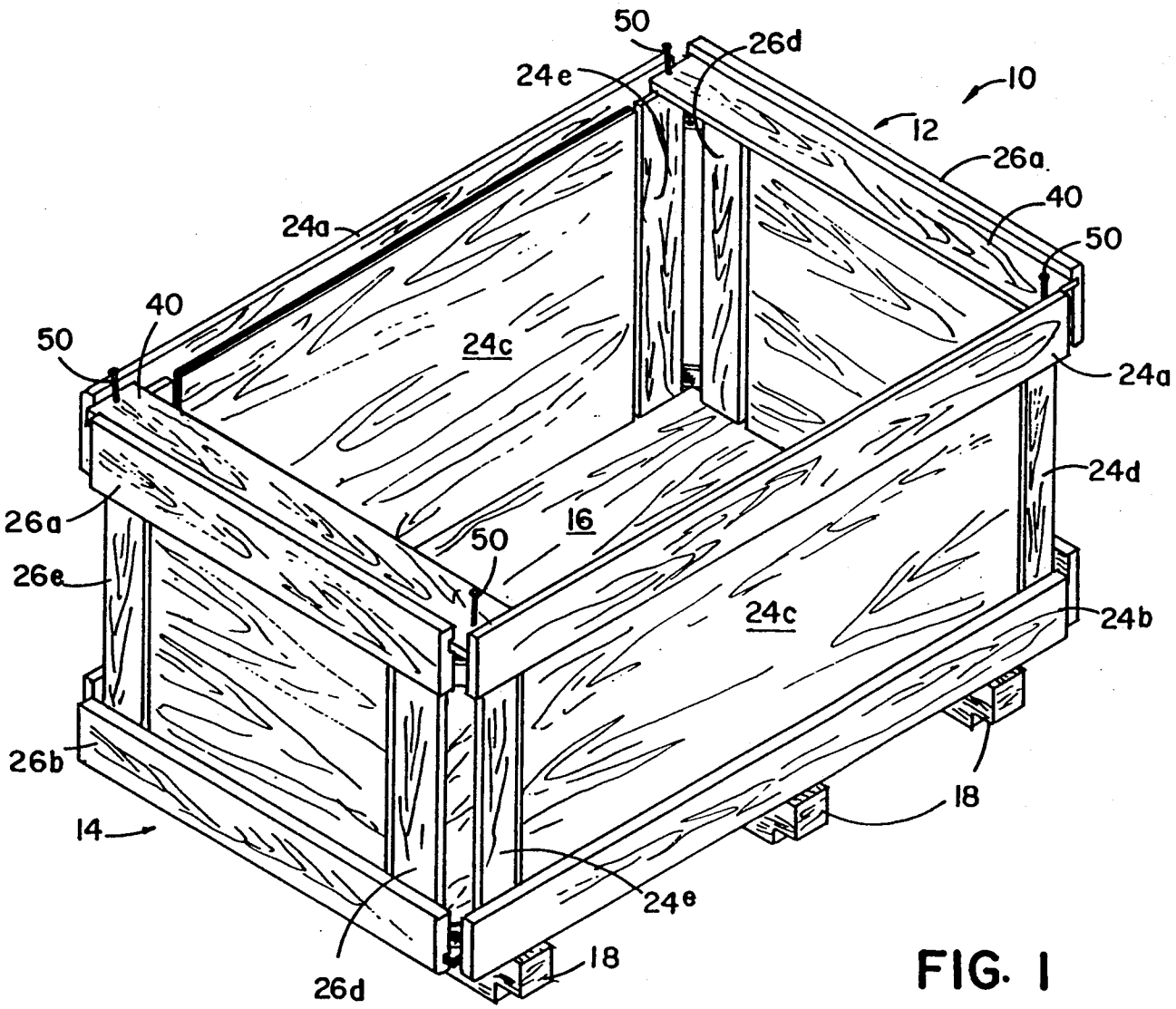
FIG. 1 is a perspective view of the novel pallet container.

Referring now specifically to the drawings, the pallet container assembly 10, sometimes designated a pallet box container, includes an upper collapsible subassembly 12 interfitted with a lower pallet subassembly 14.

In the depicted embodiment, the term "ends" of the assembly is used for convenience to refer to the vertical panels that are shorter in length than the "sides", and which contain the grooves. Obviously, all four panels are side panels, in one manner of speaking. The panels that have the grooves may be longer, shorter, or of the same length as the other two panels. The terms ends and sides are used for convenience.

Pallet subassembly 14 includes a platform 16, typically formed of plywood on a plurality of wood tie boards 17 as of oak or the like, mounted onto a substructure formed of a plurality, here three, of spaced parallel girders or runners 18 typically of wood and formed for example of four by four or two by four inch members. These girders are shown across both ends and the center of the pallet forming a pair of side openings to receive a pair of tines of a fork lift. Board layer 17 adds strength, as well as elevating panel 16 above girders 18 for appropriate interengagement with the upper subassembly 12, as will be explained more fully hereinafter. A second, floor-engaging bottom platform (not shown) may be mounted to the base of the girders, if desired. The ends of the girders extend beyond the platform, i.e., beyond board layer 17 and panel 16, to create support and stop surfaces for the vertical side panels of the upper subassembly, as will be explained hereinafter.

Two opposite, planar portions of plywood panel 16 specially extend beyond the girders 18 and tie boards 17. These two portions are here shown to be at the two ends 16' (FIG. 2) of the platform. This enables the edge of the platform to form the "tongue" part of a "tongue and groove" connection to the upper subassembly as described hereinafter. Alternatively, the tie boards 17 can be used without plywood layer 16 and, if so, these tie boards should extend beyond the ends of the girders to engage the end panels in a like manner to that described herein.

Collapsible upright polygonal subassembly 12 is formed of a plurality of four vertical panels arranged in rectangular configuration, including two upright side panels 24 parallel to each other and two upright end panels 26 parallel to each other and normal to side panels 24 when the polygon is expanded. The vertical end edges of end panels 26 are adjacent to and horizontally spaced slightly from the vertical end edges of side panels 24. Each of the side panels is preferably composed of a pair of upper and lower, spaced, horizontal stringers **24*a* and 24*b* respectively, to the inner faces of which is attached a central plate 24*c* as of plywood, and also a pair of vertical end plates 24*d* and 24*e***.

Similarly, each of end panels 26 is formed of a pair of upper and lower, vertically spaced, horizontal, parallel stringers **26*a* and 26*b*, a central panel 26*c* and a pair of vertical end plate elements 26*d* and 26*e*. Extending between and connecting each of panels 24 and adjacent panels 26 is a pair of upper and lower flexible belts 46*a* and 46*b* of woven polymeric material basically comparable to that conventionally used for vehicle safety seat belts. In order to conserve belting material, these connectors do not extend clear around the periphery of the structure, but rather are in segments having the ends thereof fixedly secured between the horizontal stringers and vertical upright elements of the side panels and also the end panels. This can be achieved by stapling through the upright elements, belt segments and horizontal stringers, and optionally also adhering the components together. Although two belt segments are shown, the number thereof could be varied. The belt segments are shown located near the top portion and near the bottom portion of each corner of subassembly 12, leaving space on bottom stringers 26*b* for grooves (to be described). Specifically, upper belt elements 46*a* are secured at the corners between the upper side stringers 24***a* and opposite end panels 24*d* and 24*e* on one end of the belts, and between the upper end stringers 26*a* and opposite end panels 26*d* and 26*e* on the other ends of the belts. These upper belt elements 46*a* are below the upper slots or grooves 25*a*. The lower belt elements 46*b* are secured at the corners between the lower side stringers 24*b* and side panels 24*d* and 24*e* on one end of each belt and between the lower end stringers 26*b* and the end panels 26*d* and 26*e* on the other ends of the belt elements. These lower belt elements 46*b* are above the lower slots or grooves 25*b*. The components thus form a continuum capable of collapse into a flat parallelogram subassembly (FIG. 5), or expansion into a rectangular polygon (FIG. 1). When the polygon is collapsed or otherwise not attached to the platform, the belts are slack. When the polygon is expanded and assembled to the platform, the belts are taut.

In the preferred embodiment, the peripheral dimension of the combined panels and the belting elements in relaxed condition at the base of the polygon is of a length dimension slightly smaller than the peripheral dimension of panel 16. The lower stringers 26*b* of the end panels have longitudinal grooves on the inner surface thereof of a sufficient vertical width to receive the end edges of horizontal panel 16. This enables a tongue and groove type connection to be made between the polygon and the platform Therefore, if the bottom periphery of the polygon is engaged around the platform, the belts are pulled tight, removing the slack, to cause the lower end of the polygon to fit tightly around panel 16 and in tongue and groove arrangement.

This connection of the polygon to the platform is achieved by first expanding the polygon and resting it on the platform. Then, preferably one end is lowered and secured, one side is lowered, the other end is lower and secured, and then the other side lowered. More specifically, the one end panel is lowered and its bottom groove 25*b* is fitted over the adjacent extended end 16′ of platform 16. Then one side panel is lowered until it rests on girders 18. Next, the lower end of the second end panel is forced outwardly, i.e., away from the one end panel, with tightening of belts 46*b*, until the lower groove of that end panel engages the second extended end 16′ of platform 16. This outward movement can be achieved by striking the lower inner face of this end panel with a tool, a fist or a foot. Finally, the second side panel is lowered onto girders 18.

During this process, there is vertical offset between at least one of the end panels and the side panels. The flexible straps 46*a* and 46*b* enable this to readily occur.

Figure 2:
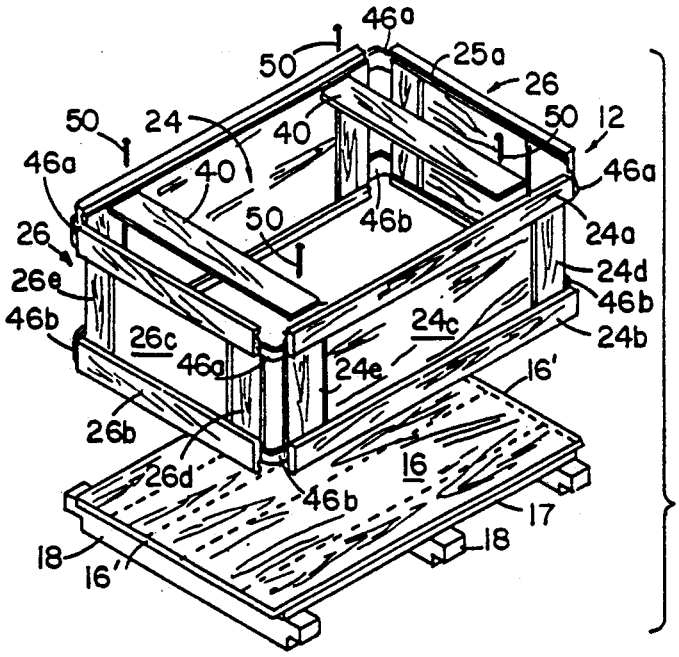
FIG. 2 is an exploded view of the two subassembly components of the pallet container in FIG. 1.
Figure 3:
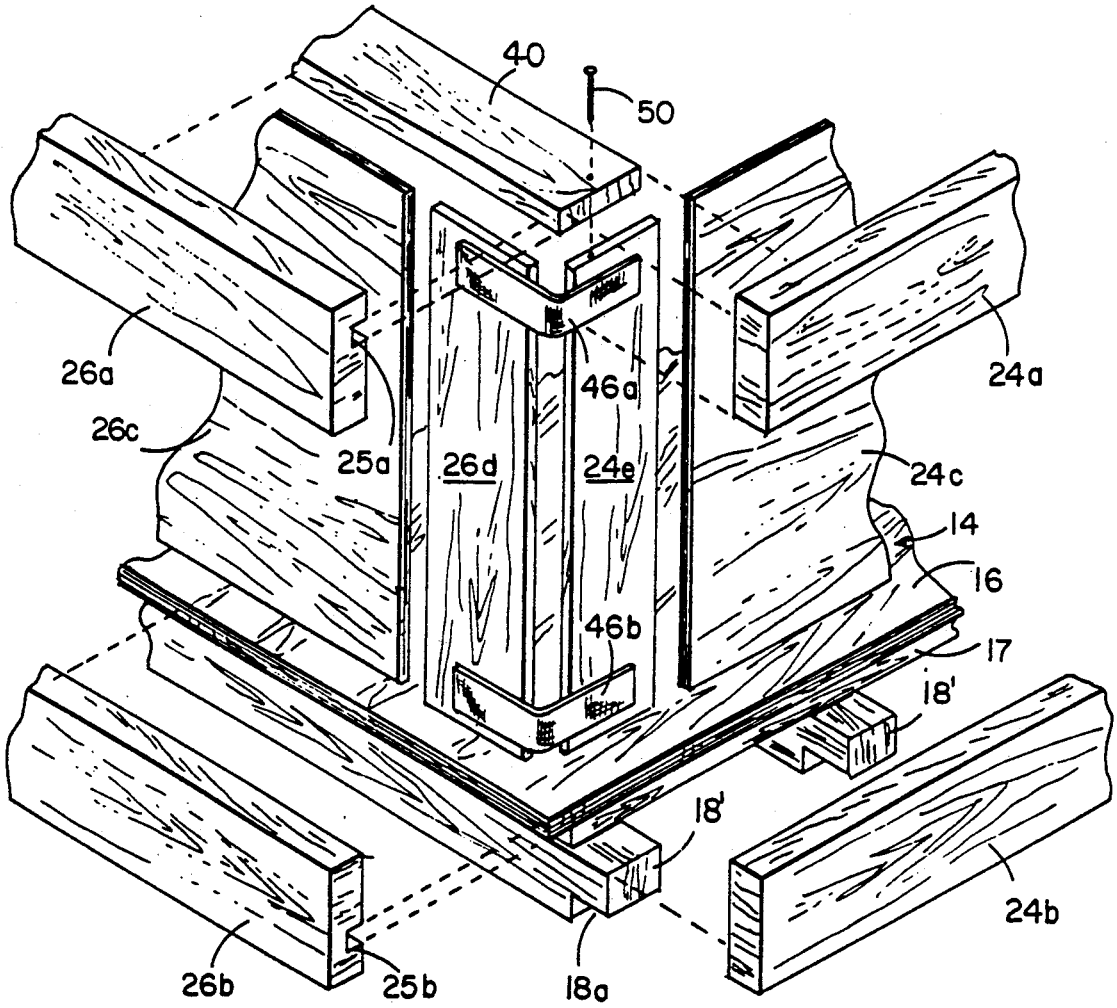
FIG. 3 is a sectional, perspective, exploded view of a corner portion of the pallet container.
Figure 9:
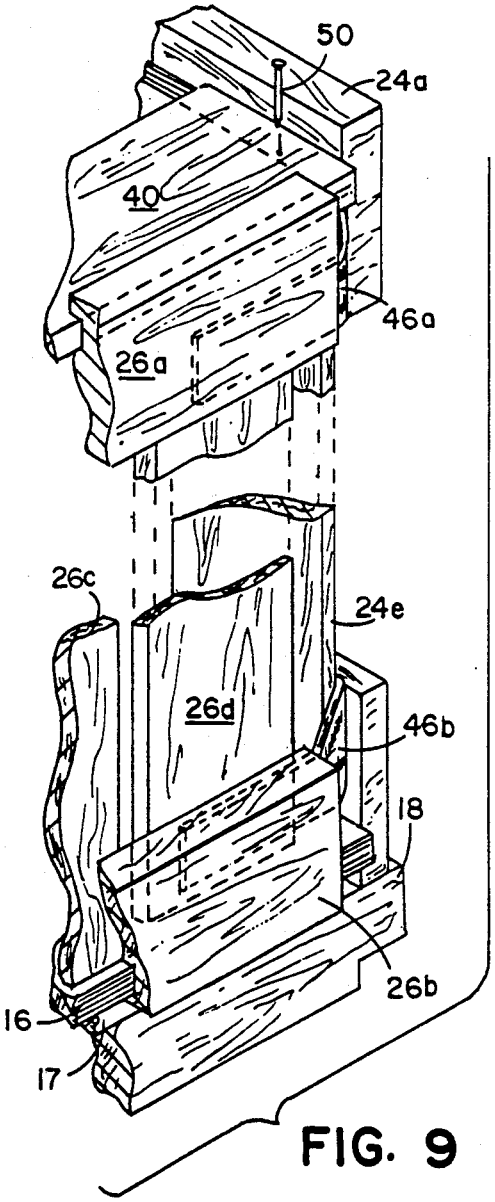
FIG. 9 is a fragmentary, exploded, perspective view of the upper right-hand corner of the assembly in FIG. 7.
Figure 7:
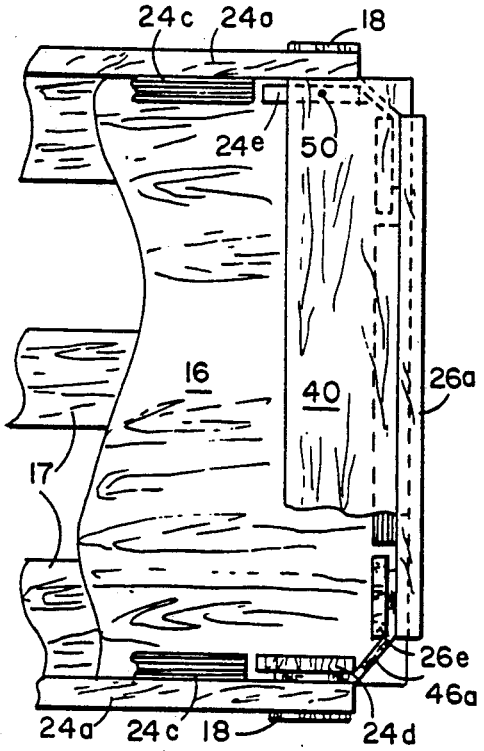
FIG. 7 is a fragmentary, plan view of one end of the assembly.
Figure 8:
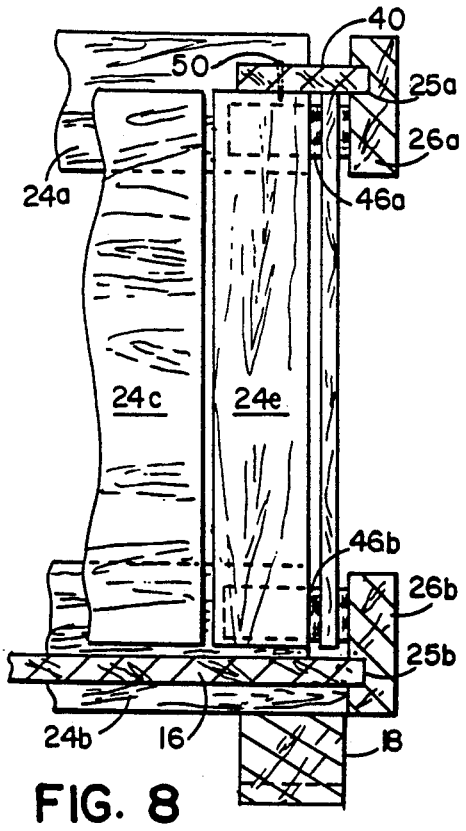
FIG. 8 is a fragmentary, sectional, elevational view taken on plane VIII—VIII of FIG. 7.

After the lower end of the polygon is so attached to the platform, the upper portion of the polygon is stabilized in fully expanded rectangular configuration in a fashion causing the lower tongue and groove connections just noted to be further secured This is done by inserting a pair of elongated wedging compression elements 40 such as boards between the upper ends of two of the opposite panels, e.g., here side panels 24 (FIG. 2). These are preferably adjacent to and having their long edges engaging the grooves of the other two panels, here the so-called end panels. These compression elements can be of wood or other stiff material, preferably of a width fitting snugly into elongated grooves 25*a* in the inner faces of upper stringers 26*a*. Optionally, nails 50 (FIG. 3) or staples or the like can be forcibly inserted down through these compression elements into the underlying shoulder of side panels 24 to prevent the compression elements from sliding toward the center of the polygon, i.e., away from the end panels. In this final assembly, the belts 46*a* and 46*b* are stretched tightly.

Figure 4:
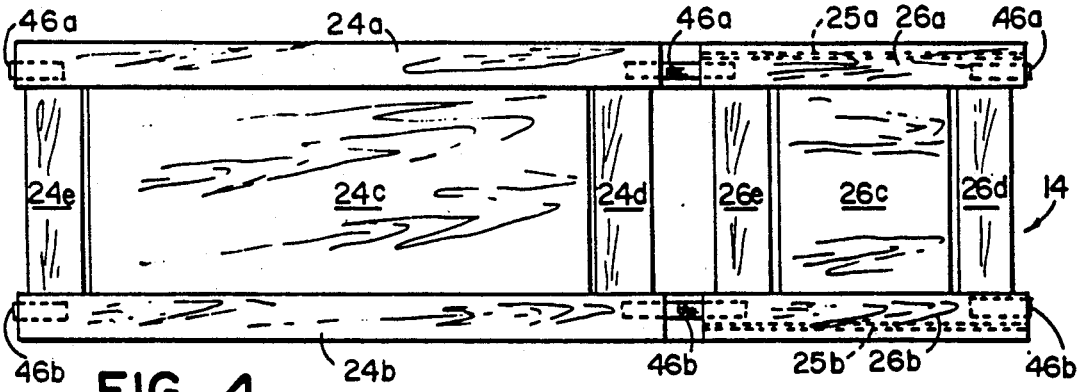
FIG. 4 is a side elevational view of the collapsed upright polygon forming part of the pallet container.
Figure 5:
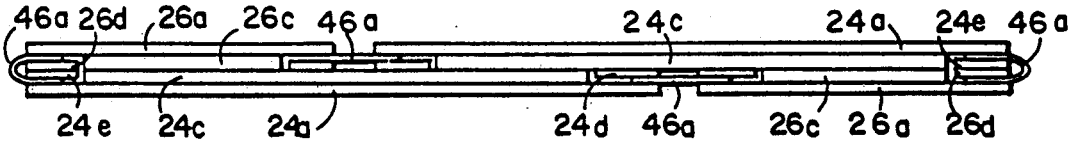
FIG. 5 is a plan view of the collapsed polygon of FIG. 4.
Figure 6:
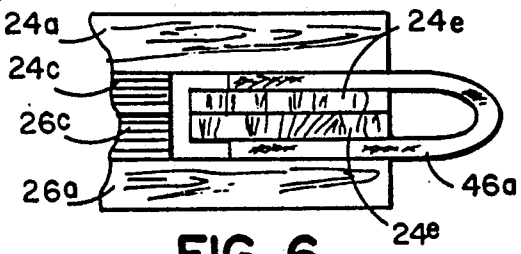
FIG. 6 is an enlarged fragmentary view of the end portion of the collapsed polygon in FIG. 4 and 5.

When the assembly is not employed for storing or hauling material, but rather is to be stored or shipped in a compact condition, the upper polygonal subassembly is quickly and easily collapsed into a parallelogram configuration like that depicted in FIGS. 4 and 5. Specifically, if the assembly is assembled as in FIG. 1, compression elements 40 are removed and the polygonal structure is released from the pallet by forcing the lower ends of the two end panels away from each other slightly to release the tongue and groove connection to the platform. The unit is lifted off, and foldably collapsed into a flat condition utilizing the flexibility of the belting, so that all four panels are substantially parallel. The collapsed polygon can then be laid on the pallet in a compact condition, if desired, or stacked for storage and/or shipping. Optionally, the undersides of the ends 18′ of girders 18 have notches or recesses 18*a* (FIG. 3) to enable one assembled container to be stacked on another like assembled container, e.g., when filled with product.

The top of the polygon is a mirror image of the bottom, such that the polygon can be inverted and engaged with the platform in that orientation, if desired, e.g., if one end gets unduly worn.

Conceivably the details of the preferred embodiment of the invention as set forth herein could be modified to suit particular circumstances, materials, or articles to be shipped. For example, the collapsible container and/or the pallet could be made of materials other than wood. The platform could be made of one layer rather than two. i.e., panel 16 and boards 17, with a vertically offset tongue on the one layer. The assembly could also have tongue and groove connections at four panels instead of two. Alternatively, the lower edges of the vertical panels could conceivably be removably connected to the pallet by other connections such as hook and loop fastener materials therebetween, e.g., the "Velcro" brand, instead of the tongue and groove connection, or in addition to the tongue and groove connection. Further, the upper corners of subassembly 14 could be stabilized by corner plates with or without the wedging stabilizers 40. Other possibilities or changes will occur to those in the art upon studying this disclosure. Hence, the invention is not intended to be limited to the specific preferred embodiment illustrated, but only by the scope of the appended claims and the reasonably equivalent structures to those defined therein.

The embodiments of the invention in which an exclusive property or privilege is claimed are defined as follows.

1. A collapsible pallet container comprising:

a support pallet having a horizontal platform with four edges and undergirders secured beneath said platform;

a plurality of two opposite, upright side panels and two opposite, upright end panels, arranged in a polygon;

said panels having vertical end edges;

said side panel vertical end edges being adjacent said end panel vertical end edges;

said vertical end edges having upper portions and lower portions;

flexible belting mounted to said panels at said upper portions and said lower portions, and extending between said side panels and said end panels in a manner to secure said panels together in a continuum capable of extension into a rectangular polygon or collapsing into a flattened parallelogram;

said platform having horizontal tongues protruding from at least two of its opposite edges;

said panels having upper and lower portions;

said lower portions of at least two opposite ones of said panels having grooves of a size and location to receive said tongues of said platform, whereby the lower portion of said polygon can be mounted to said platform; and removable wedging compression members between two opposite ones of said upright panels, to rigidify said polygon, thereby forming a stable pallet container capable of purposeful collapsing.

2. The collapsible pallet container in claim 1 wherein said belting is anchored in said panels adjacent said end edges.

3. The collapsible pallet container in claim 1 wherein said wedging compression members are adjacent the other two opposite ones of said upright panels.

4. The collapsible pallet container in claim 1 wherein said belting is woven polymeric material.

5. The collapsible pallet container in claim 1 wherein said undergirders have ends which extend beyond said platform to form support and stop surfaces for said panels.

6. The collapsible pallet container in claim 1 wherein said upper portions of said at least two opposite ones of said panels have grooves of a size and location to receive said compression members.

7. A collapsible pallet container comprising a support pallet having pairs of opposite edges;

a collapsible upright polygon having pairs of opposite vertical panels forming lower portions and upper portions of said polygon;

flexible tension means between said panels for binding said panels together such that said polygon is expandable or collapsible;

attachment means between said polygon lower portions and said pallet for mounting said polygon to said pallet; and panel stabilizer means between said polygon upper portions for retaining said polygon upper portions expanded and for keeping said panels attached to said pallet.

8. The collapsible pallet in claim 7 wherein said attachment means comprise tongue and groove connections.

9. The collapsible pallet in claim 8 wherein said tongue and groove connections include tongues on said pallet and grooves on said panels.

10. The collapsible pallet container in claim 8 wherein said panel stabilizer means comprises removable wedging compression elements extending between opposite ones of said panels.

11. The collapsible pallet container in claim 8 wherein said support pallet has undergirders and a platform, said undergirders having ends extending beyond said platform on two sides of said platform, to form support and stop surfaces for a pair of said opposite panels.

12. The pallet container in claim 7 wherein said support pallet comprises a platform mounted on a plurality of girders;

said platform having a panel with at least two opposite edges forming tongues; and said polygon having grooves in said lower portions of a size and location to receive said tongues.

13. The pallet container in claim 12 wherein said platform comprises a lower layer on said girders, and a panel on said lower layer, said panel extending beyond said lower layer at said two opposite edges, to form said tongues.

14. The pallet container in claim 13 wherein the peripheral dimension of said panel is greater than the inside peripheral dimension of said polygon.

15. The pallet container in claim 13 wherein said girders extend beyond said lower layer and beyond said panel at its other two opposite edges, to form support and stop surfaces for a pair of said vertical panels of said polygon.

16. The pallet container in claim 10 wherein said opposite ones of said panels have grooves at the upper ends thereof to receive said compression elements.

* * * * *